US010738640B2

(12) United States Patent
Kitagawa et al.

(10) Patent No.: US 10,738,640 B2
(45) Date of Patent: Aug. 11, 2020

(54) SHROUD, BLADE MEMBER, AND ROTARY MACHINE

(71) Applicant: MITSUBISHI HEAVY INDUSTRIES, LTD., Tokyo (JP)

(72) Inventors: Hitoshi Kitagawa, Tokyo (JP); Takashi Hiyama, Yokohama (JP); Daigo Fujimura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 341 days.

(21) Appl. No.: 15/122,303

(22) PCT Filed: Mar. 11, 2015

(86) PCT No.: PCT/JP2015/057138
§ 371 (c)(1),
(2) Date: Aug. 29, 2016

(87) PCT Pub. No.: WO2015/137393
PCT Pub. Date: Sep. 17, 2015

(65) Prior Publication Data

US 2016/0369643 A1 Dec. 22, 2016

(30) Foreign Application Priority Data

Mar. 13, 2014 (JP) ..... 2014-050599

(51) Int. Cl.
*F01D 5/22* (2006.01)
*F01D 11/02* (2006.01)
*F01D 15/10* (2006.01)

(52) U.S. Cl.
CPC ..... *F01D 11/02* (2013.01); *F01D 5/225* (2013.01); *F01D 15/10* (2013.01); *F05D 2220/32* (2013.01)

(58) Field of Classification Search
CPC . F01D 5/22; F01D 5/225; F01D 11/02; F01D 15/10; F01D 5/143; F05D 2260/30; F05D 2260/32; F05D 2260/37
See application file for complete search history.

(56) References Cited

U.S. PATENT DOCUMENTS 4,243,360 A 1/1981 Wright
4,576,551 A * 3/1986 Olivier ..... F01D 5/225 29/889.21

(Continued)

FOREIGN PATENT DOCUMENTS

JP 10-317905 12/1998
JP 2004-52757 2/2004

(Continued)

OTHER PUBLICATIONS

International Search Report dated Jun. 16, 2015 in corresponding International Application No. PCT/JP2015/057138.

(Continued)

*Primary Examiner* — Kenneth J Hansen
*Assistant Examiner* — Maxime M Adjagbe
(74) *Attorney, Agent, or Firm* — Wenderoth, Lind & Ponack, L.L.P.

(57) ABSTRACT

A shroud (22) comprises shroud bodies (22) fixed to blade tips of blades (18) mounted to a rotor body to extend in a radial direction, the shroud bodies (22) being disposed adjacent to one another in a circumferential direction, wherein each of the shroud bodies (22) includes a circumferential end surface (27, 28) that includes an abutting end surface where adjacent shroud bodies (22) abut, and an opposing surface (34) where adjacent shroud bodies (22) face one another with a clearance (32) therebetween, the opposing surface (34) being contiguous with the abutting end surface; and an outer surface (24) that includes a radially (Continued)

outward protruding protrusion (40) formed to extend along the opposing surface (34).

7 Claims, 8 Drawing Sheets

(56) References Cited

U.S. PATENT DOCUMENTS

| | | | | |
|---|---|---|---|---|
| 7,001,152 | B2 * | 2/2006 | Paquet | F01D 5/225 29/889.21 |
| 7,396,205 | B2 * | 7/2008 | Dube | F01D 5/143 415/173.5 |
| 7,628,587 | B2 * | 12/2009 | McFeat | F01D 5/141 416/189 |
| 2005/0079058 | A1 | 4/2005 | Paquet et al. | |
| 2008/0019835 | A1 | 1/2008 | McFeat et al. | |
| 2009/0180894 | A1 * | 7/2009 | Brittingham | F01D 5/225 416/97 R |
| 2012/0195766 | A1 | 8/2012 | Cohin et al. | |
| 2013/0170964 | A1 | 7/2013 | Chouhan et al. | |

FOREIGN PATENT DOCUMENTS

| | | |
|---|---|---|
| JP | 2007-321721 | 12/2007 |
| JP | 2011-106474 | 6/2011 |
| JP | 2013-117227 | 6/2013 |
| JP | 2013-147999 | 8/2013 |
| JP | 2014-500432 | 1/2014 |

OTHER PUBLICATIONS

Written Opinion of the International Searching Authority dated Jun. 16, 2015 in corresponding International Application No. PCT/JP2015/057138.

* cited by examiner

SHROUD, BLADE MEMBER, AND ROTARY MACHINE

TECHNICAL FIELD

The present invention relates to a shroud fixed to a blade tip of a blade of a rotary machine, a blade member with the shroud, and a rotary machine.

This application claims priority based on Japanese Patent Application No. 2014-050599 filed in Japan on Mar. 13, 2014, of which the contents are incorporated herein by reference.

BACKGROUND ART

In recent years, gas turbines have been designed to operate at higher temperatures and with increased efficiency. This has led to a trend of increasing the length of the turbine blades (providing long blades). Such blades, while having a reduced vibration frequency due to the increased blade length, have an increased susceptibility to the occurrence to flutter and other unstable vibrations.

To combat this, tip shrouds have been disposed on the tips of blade bodies that constitute the turbine blades to increase the natural frequency and/or structural damping of the turbine blades, thus suppressing the occurrence of vibrations. Adjacent tip shrouds of such turbine blades abut one another to reduce leakage flow between blade tips. Vibrations are also dampened by the adjacent tip shrouds abutting one another. To prevent damage caused by heterogeneous contact and stress concentration at corner portions however, tip shrouds have been provided with a portion with a gap via which adjacent tip shrouds do not abut one another (see, for example, Patent Document 1).

CITATION LIST

Patent Documents

Patent Document 1: Japanese Unexamined Patent Application Publication No. H10-317905A

SUMMARY OF THE INVENTION

Technical Problem

Through such a gap, combustion gas from the main flow may leak out into a cavity located radially outward from the tip shrouds causing loss and the reduction in performance of the turbine.

An object of the present invention is to provide shrouds capable of reducing the amount of fluid that leaks out through the clearance between the shrouds. Such shrouds are disposed adjacent to one another in the circumferential direction, each of the shrouds being fixed to a blade tip of a blade mounted to a rotor body to extend in the radial direction.

Solution to Problem

A first embodiment of the present invention is a shroud comprising:

shroud bodies fixed to blade tips of blades mounted to a rotor body to extend in a radial direction, the shroud bodies being disposed adjacent to one another in a circumferential direction, wherein each of the shroud bodies includes a circumferential end surface that includes an abutting end surface where adjacent shroud bodies abut, and an opposing surface where adjacent shroud bodies face one another with a clearance therebetween, the opposing surface being contiguous with the abutting end surface; and an outer surface that includes a radially outward protruding protrusion formed to extend along the opposing surface.

According to such a configuration, the protrusion acts as a dam and the fluid that convects in the radially outer region of the shroud stagnates. As a result, pressure rises at the radially outward outlet of the clearance causing the flow of the fluid flowing at these locations to be inhibited. In other words, the amount of fluid that leaks out from the clearance is reduced.

The shroud described above may further have a configuration wherein the protrusion is disposed at a position on the outer surface furthest to a leading side in a rotational direction of the blades.

According to such a configuration, a pressure rise occurs at the proximity of the outlet of the clearance due to the stagnation. This allows the amount of fluid that leaks out from the clearance to be further reduced.

The shroud described above may further have a configuration wherein the clearance has a distance between the adjacent opposing surfaces that is greater at a side approximate to the abutting end surface; and the protrusion protrudes from the outer surface to a greater degree at the side approximate to the abutting end surface.

According to such a configuration, the shape of the protrusion can be optimized. In other words, the height of the protrusion can be made appropriate depending on the size of the clearance.

The shroud described above may further have a configuration wherein the protrusion includes a canopy portion that at least partially covers a radially outward side of the clearance when viewed in the radial direction.

According to such a configuration, by the fluid that leaks out from the clearance coming into contact with the canopy portion, the amount of fluid that directly leaks out can be reduced.

The shroud described above may further have a configuration wherein the protrusion is formed continuously with the opposing surface of the adjacent opposing surfaces that is located closer to where the blade is mounted.

According to such a configuration, a shroud can be formed which minimizes increases in bending loads due to centrifugal force.

A second embodiment of the present invention is a blade member comprising:

a blade body, which is a blade mounted to a rotor body to extend in a radial direction; and the shroud described above.

Another embodiment of the present invention is a rotary machine comprising: the blade member described above.

Advantageous Effects of Invention

According to the present invention, the amount of fluid that leaks out through the clearance between the shrouds can be reduced by the shrouds being disposed adjacent to one another in the circumferential direction, with each of the shrouds being fixed to a blade tip of a blade mounted to a rotor body to extend in the radial direction.

DESCRIPTION OF EMBODIMENTS

First Embodiment

Figure 1:
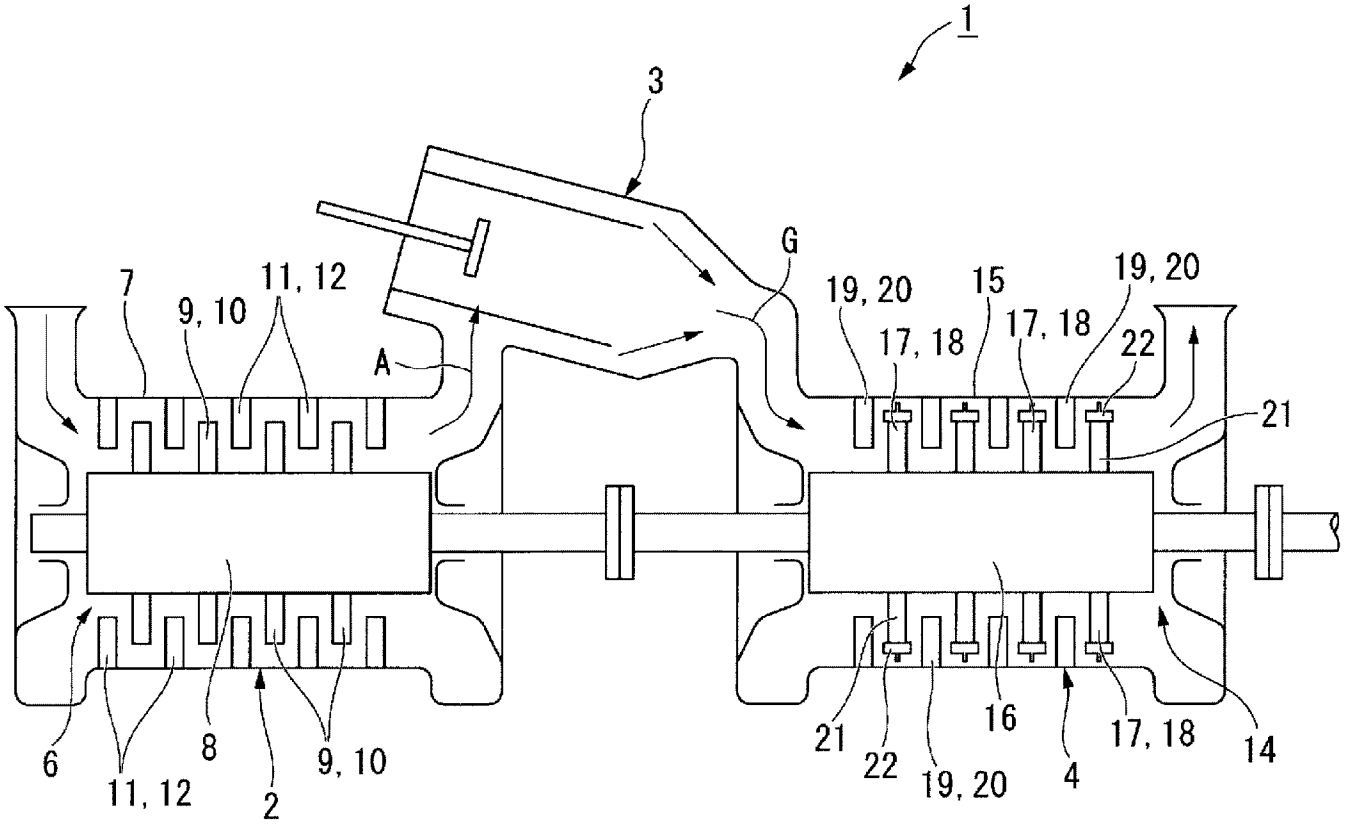
FIG. 1 is a schematic view of the configuration of a gas turbine of the first embodiment according to the present invention.

A gas turbine 1, which is a rotary machine of the first embodiment of the present invention, will be described below in detail with reference to the attached drawings. FIG. 1 is a schematic view of the gas turbine 1 of the first embodiment of the present invention.

As illustrated in FIG. 1, a gas turbine 1 includes a compressor 2 that compresses outside air to generate compressed air, a combustor 3 that combusts fuel in the presence of compressed air to generate combustion gas, and a turbine 4 that is driven by high-temperature high-pressure combustion gas.

Hereinafter, the axial direction of the compressor 2 and the turbine 4 may be simply referred to as "axial direction" or "axial"; the circumferential direction of the compressor 2 and the turbine 4 may be simply referred to as "circumferential direction" or "circumferential"; and the radial direction of the compressor 2 and the turbine 4 may be simply referred to as "radial direction" or "radial".

The compressor 2 includes a compressor rotor 6 and a compressor casing 7 that covers the compressor rotor 6. The compressor rotor 6 includes a compressor rotor shaft 8 that rotates about the rotation central axis and a plurality of compressor blade arrays 9 fixed on the periphery of the compressor rotor shaft 8 disposed at intervals in the axial direction.

Each of the compressor blade arrays 9 includes a plurality of compressor blades 10 disposed on the periphery of the compressor rotor shaft 8 arranged at equal intervals in the circumferential direction. The compressor blades 10 extend toward the inner surface of the compressor casing 7.

A plurality of compressor vane arrays 11 are disposed and fixed at the inner surface of the compressor casing 7 at intervals in the axial direction. Each of the compressor vane arrays 11 includes a plurality of compressor vanes 12 disposed on the inner surface of the compressor casing 7 arranged at equal intervals in the circumferential direction. The compressor vanes 12 extend toward the compressor rotor shaft 8.

The compressor vane arrays 11 and the compressor blade arrays 9 are disposed in stages in the compressor casing 7, the compressor vane arrays 11 and the compressor blade arrays 9 alternating in the axial direction.

The turbine 4 includes a turbine rotor 14 co-rotatably coupled to the compressor rotor 6 and a turbine casing 15 that covers the turbine rotor 14. The turbine rotor 14 includes a turbine rotor shaft 16 (rotor body) that rotates about the rotation central axis and a plurality of turbine blade arrays 17 fixed on the periphery of the turbine rotor shaft 16 at intervals in the axial direction.

Each of the turbine blade arrays 17 includes a plurality of turbine blades 18 (blade members) disposed on the periphery of the turbine rotor shaft 16 arranged at equal intervals in the circumferential direction. The turbine blades 18 extend toward the inner surface of the turbine casing 15.

A plurality of turbine vane arrays 19 are disposed and fixed at the inner surface of the turbine casing 15 at intervals in the axial direction. Each of the turbine vane arrays 19 includes a plurality of turbine vanes 20 disposed on the inner surface of the turbine casing 15 arranged at equal intervals in the circumferential direction. The turbine vanes 20 extend toward the turbine rotor shaft 16.

The turbine vane arrays 19 and the turbine blade arrays 17 are disposed in stages in the turbine casing 15, the arrays 19, 17 alternating in the axial direction.

The turbine rotor 14 may, for example, be connected to a generator that generates electricity by the rotation of the turbine rotor 14.

Of the turbine blade arrays 17 of the multiple stages, at least the turbine blade arrays 17 of one stage are constituted by turbine blades 18, each of the turbine blades 18 includes a blade body 21 and a tip shroud 22 fixed to the blade tip of the blade body 21. The tip shrouds 22 are disposed adjacent in the circumferential direction with a portion of adjacent tip shrouds 22 abutting. In other words, each tip shroud 22 is in contact with another tip shroud 22 of the gas turbine 1 blade adjacent in the circumferential direction. The adjacent tip shrouds 22 also push against one another.

Figure 2:
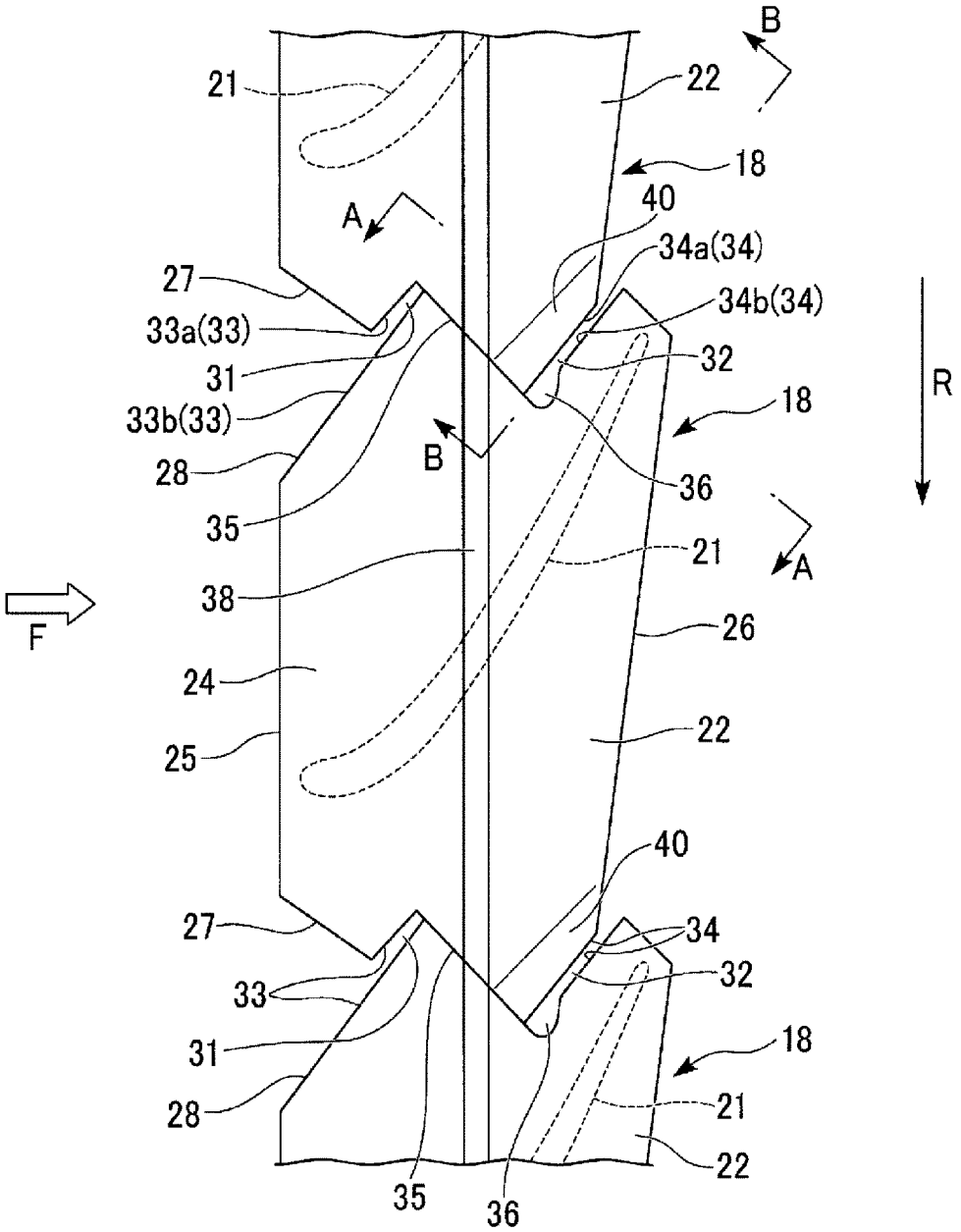
FIG. 2 is a view from a position radially outward of the turbine of a turbine blade of the first embodiment of the present invention.
Figure 3:
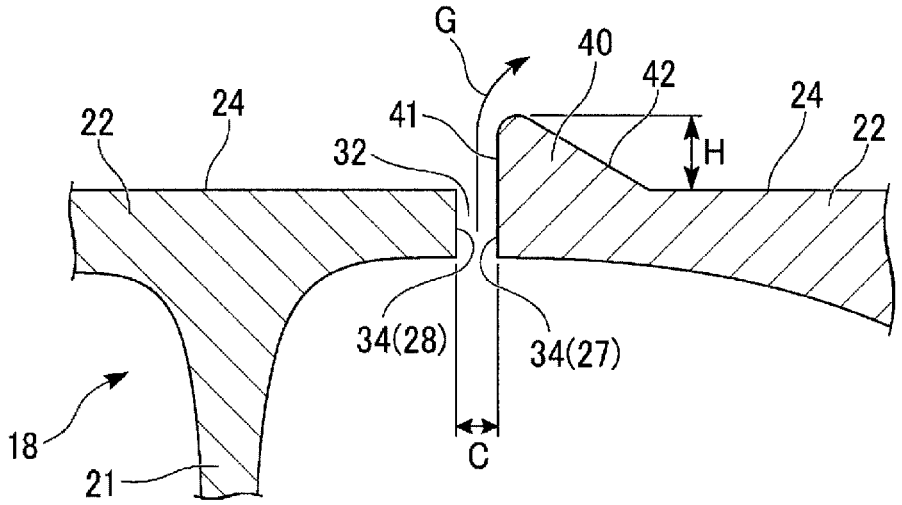
FIG. 3 is a cross-sectional view taken along A-A of FIG. 2 and illustrates the cross-sectional shape of a protrusion of the first embodiment of the present invention.

As illustrated in FIG. 2 and FIG. 3, the tip shrouds 22 are planar members that act together to suppress vibrations that occur upon rotation of the turbine blades 18. The tip shroud 22 is integrally formed with the blade body 21 at the radially outward side of the turbine blade 18.

Though not illustrated, at the radially inward side of the blade body 21, the turbine blade 18 further includes a platform that protrudes out from the blade body 21 and a blade root that protrudes from the platform further radially inward. The turbine blades 18 are integrally fixed to the turbine rotor shaft 16 by the blade roots being mounted to the outer surface of the turbine rotor shaft 16.

As illustrated in FIG. 2, the blade body 21 has a curved airfoil-shaped cross section that is convex to one side in the circumferential direction (the leading side of the rotational direction R of the turbine rotor 14, the lower side of FIG. 2) from the leading edge corresponding to upstream of the combustion gas flow direction F through to the trailing edge corresponding to downstream along the axial direction. This cross section has an airfoil shape that extends toward the other side in the circumferential direction (the trailing side of the rotational direction R of the turbine rotor 14, the upper side of FIG. 2) while extending downstream in the combustion gas flow direction F (right side of FIG. 2).

As illustrated in FIG. 3, the tip shroud 22 has a planar shape with a predetermined thickness in the radial direction and is integrally fixed to the blade body 21 protruding in the circumferential direction at the radially outward side of the blade body 21. The surface of the tip shroud 22 that faces radially outward corresponds to an outer surface 24 of the tip shroud 22.

The tip shroud 22 includes an upstream end surface 25, which is the surface that faces one side in the axial direction corresponding to the upstream side (upstream side of combustion gas flow direction F, left side of FIG. 2) and extends conforming to the circumferential direction, and a downstream end surface 26, which is the surface that faces the other side in the axial direction corresponding to the downstream side and extends conforming to the circumferential direction.

Additionally, the tip shroud 22 includes a first circumferential end surface 27, which is the surface that faces the leading side of the rotational direction R, i.e. one side in the circumferential direction, and a second circumferential end surface 28, which is the surface that faces the trailing side of the rotational direction R, i.e. the other side in the circumferential direction.

Two minute clearances 31, 32 are disposed between adjacent tip shrouds 22 taking into account deformation of the tip shroud 22 upon operation. The first clearance 31 is disposed to the upstream side and the second clearance 32 is disposed downstream.

The first clearance 31 and the second clearance 32 run substantially parallel to the chord direction of the blade body 21. The first clearance 31 is disposed offset to the trailing side of the rotational direction R of the turbine rotor 14.

The first circumferential end surface 27 and the second circumferential end surface 28 include first opposing surfaces 33 (33*a*, 33*b*), which are opposing surfaces intermediated by the first clearance 31; second opposing surfaces 34 (34*a*, 34*b*), which are opposing surfaces intermediated by the second clearance 32; and abutting end surfaces 35 disposed between the first opposing surfaces 33 and the second opposing surfaces 34.

The abutting end surface 35 is disposed between the first clearance 31 and the second clearance 32 and runs substantially orthogonal to the extending direction thereof. At at least one end of the abutting end surface 35 (in the present embodiment, to the side of the second clearance 32), a relief hole 36 with a width greater than that of the clearance is provided to help prevent contact. In other words, the second clearance 32 has a distance between the second opposing surfaces 34 that is greater at the side approximate to the abutting end surface 35.

A fin 38 is formed on the outer surface 24 of the tip shroud 22. The fin 38 protrudes radially outward and extends in the circumferential direction. The fin 38 is formed continuously on adjacent tip shrouds 22. The fin 38 has a planar shape with the dominant surface thereof formed to run orthogonal to the axial direction.

A protrusion 40 is formed on the outer surface 24 of the tip shroud 22. The protrusion 40 reduces the amount of fluid, i.e. combustion gas, that leaks out from the second clearance 32. The protrusion 40 is formed to extend along the second opposing surface 34. Specifically, the protrusion 40 is formed along the second opposing surface 34, which defines the second clearance 32, at a position furthest to the leading side in the rotational direction R of the turbine rotor 14.

As illustrated in FIG. 3, the protrusion 40 includes a fluid contact surface 41, which shares a surface with the second opposing surface 34, and a gently inclined surface 42 connecting the radially outward end of the fluid contact surface 41 and the outer surface 24 of the tip shroud 22. The radial height H of the protrusion 40 is a maximum of approximately five times dimension C of the second clearance 32 and preferably from approximately two to three times.

Figure 4:
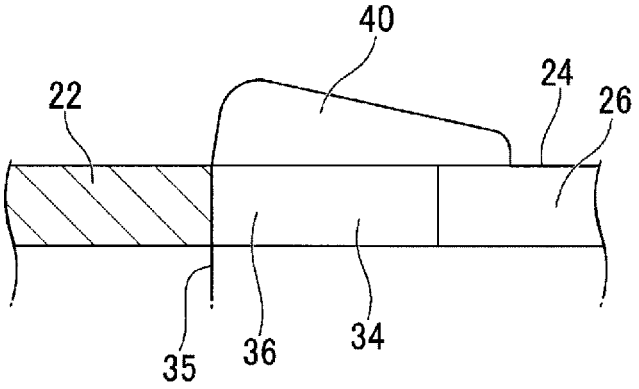
FIG. 4 is a cross-sectional view taken along B-B of FIG. 2 to facilitate explanation of the height of the protrusion of the first embodiment of the present invention.

As illustrated in FIG. 4, the protrusion 40 is formed with a height that modestly increases in the proximity of the relief hole 36. In other words, the protrusion 40 protrudes from the outer surface 24 to a greater degree at the side approximate to the abutting end surface 35. Note that the height of the protrusion 40 does not need to be increased in the proximity of the relief hole 36 and may be a uniform height in the extending direction.

According to the embodiment described above, the protrusions 40 act as a dam and the fluid that convects in the radially outer region of the tip shroud 22 stagnates. As a result, pressure rises at the radially outward outlet of the second clearance 32 causing the flow of the combustion gas flowing at these locations to be inhibited. In other words, the amount of combustion gas that leaks out from the second clearance 32 can be reduced, thus improving the efficiency of the turbine 4.

In addition, by the protrusion 40 being provided at a position on the outer surface 24 furthest to the leading side of the rotational direction R of the turbine rotor 14, a pressure rise occurs at the proximity of the outlet of the second clearance 32 due to stagnation. This allows the amount of combustion gas that leaks out from the second clearance 32 to be further reduced.

By forming the protrusion 40 protruding from the outer surface 24 to a greater degree at the side approximate to the abutting end surface 35, the shape of the protrusion 40 can be optimized. In other words, the height of the protrusion 40 can be made appropriate depending on the size of the second clearance 32.

Figure 5:
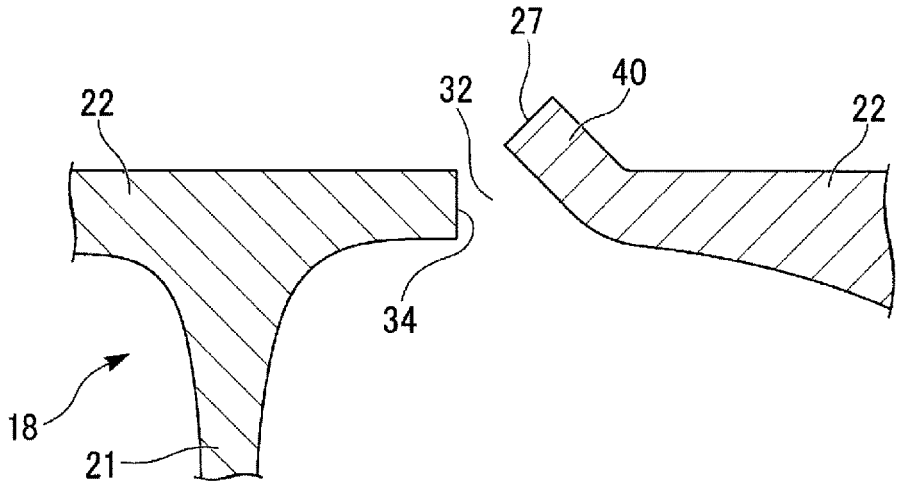
FIG. 5 is a diagram illustrating the cross-sectional shape of the protrusion according to a modified example of the first embodiment of the present invention.

Note that the protrusion 40 is not limited to a shape such as the one described above and can be changed as appropriate depending on the method of manufacturing the turbine blades 18 and the like. As illustrated in FIG. 5 for example, a portion of the circumferential end surface 27 of the tip shroud 22 may bend radially outward. In consideration of forming the protrusion 40 on an existing tip shroud 22, such a shape is preferable.

Figure 6:
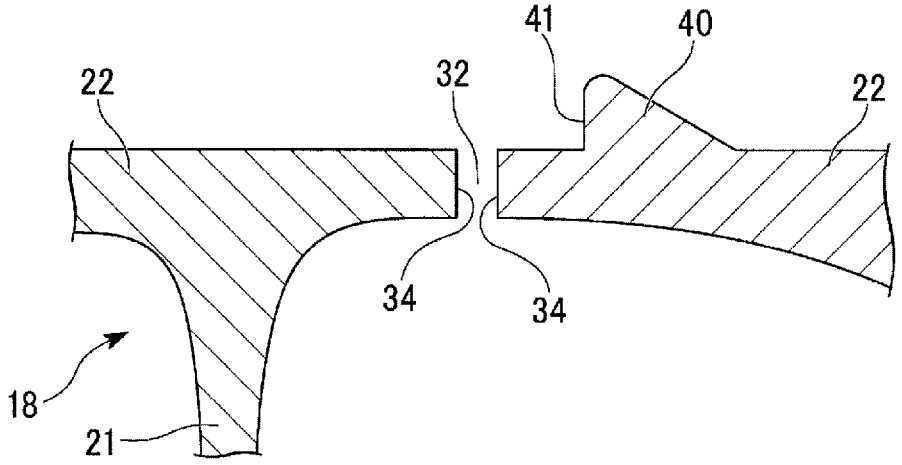
FIG. 6 is a diagram illustrating the cross-sectional shape of the protrusion according to a modified example of the first embodiment of the present invention.

In addition, the protrusion 40 is not limited to a position in proximity to the clearance 32. In other words, the fluid contact surface 41 of the protrusion 40 does not need to be disposed sharing a surface with the opposing surface 34 and may be disposed at a distance from the opposing surface 34, as illustrated in FIG. 6.

The protrusion 40 is also not limited to being formed on the side of the second clearance 32 and may be formed on the side of the first clearance 31.

Second Embodiment

Figure 7:
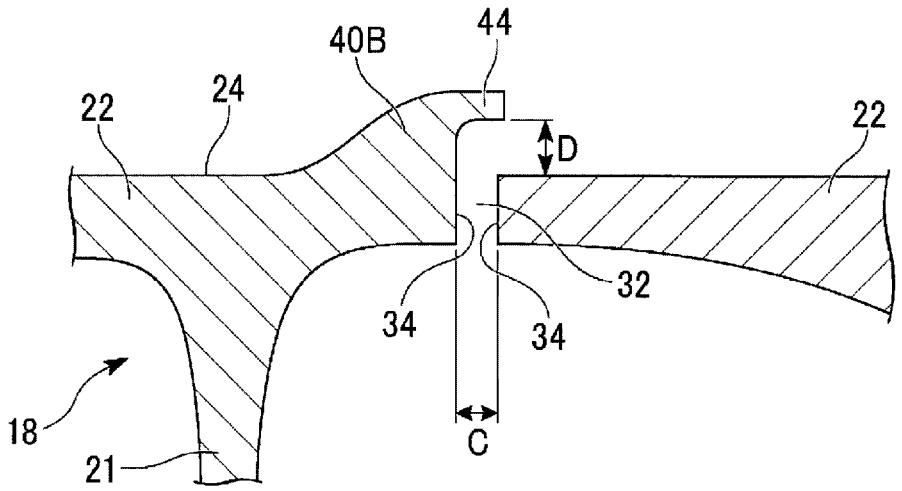
FIG. 7 is a diagram illustrating the cross-sectional shape of the protrusion of the second embodiment of the present invention.

Hereinafter, the tip shroud 22 of a second embodiment of the present invention will be described with reference to the drawings. FIG. 7 illustrates a cross-sectional shape of a protrusion 40B of the second embodiment of the present invention. FIG. 7 correlates to FIG. 3 of the first embodiment. Note that, in the present embodiment, points that are different from the above-described first embodiment will be mainly described, and a description will be omitted of the portions that are the same.

As illustrated in FIG. 7, the protrusion 40B of the present embodiment is disposed at a position on the outer surface 24 of the tip shroud 22 furthest to the trailing side in the rotational direction R. In other words, the protrusion 40 is formed continuously with the opposing surface 34 of the pair of opposing surfaces 34 that is located closer to where the blade body 21 is mounted.

In addition, the protrusion 40B includes a canopy portion 44 formed covering the radially outward side of the clearance 32. The canopy portion 44 may be formed covering all of the clearance 32 or may be formed at least partially covering the clearance 32. In other words, the canopy portion 44 is formed at least partially overlapping the clearance 32 when the clearance 32 is viewed from a position radially outward thereof.

In addition, a space D between the radially outward surface of the canopy portion 44 and the outer surface 24 is at most equal to the dimension C of the clearance.

According to embodiment described above, by forming the canopy portion 44 on the protrusion 40B, the combustion gas that leaks out from the second clearance 32 comes into contact with the canopy portion 44. Thus, the amount of combustion gas that leaks out can be reduced.

Additionally, by forming the protrusion 40B with the canopy portion 44 continuously with the opposing surface 34 of the pair of opposing surfaces 34 that is located closer to where the blade body 21 is mounted, the tip shroud 22 which minimizes increases in bending loads due to centrifugal force can be formed.

Figure 8:
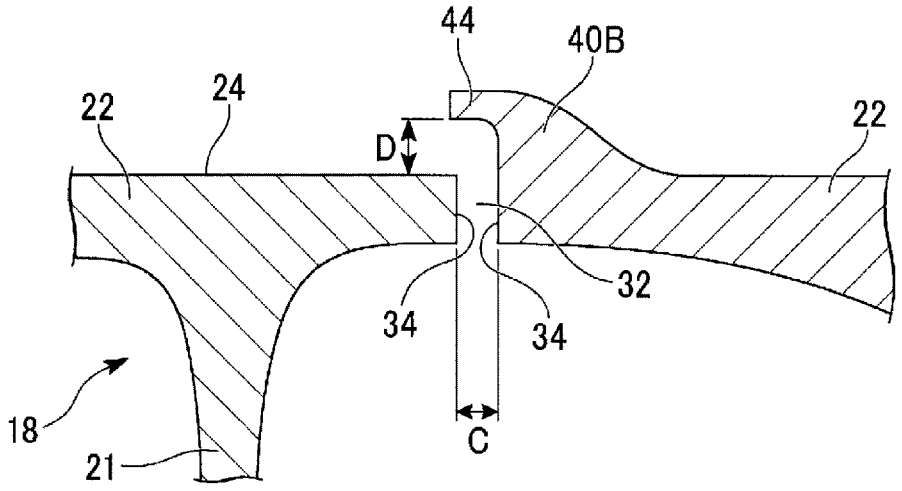
FIG. 8 is a diagram illustrating the cross-sectional shape of the protrusion according to a modified example of the second embodiment of the present invention.

Note that in the embodiment described above, the protrusion 40 with the canopy portion 44 is formed continuously with the opposing surface 34 of the pair of opposing surfaces 34 that is located closer to where the blade body 21 is mounted. However the protrusion 40 is not limited to being formed as such. As illustrated in FIG. 8 for example, the protrusion 40B may be formed continuously with the opposing surface 34 of the pair of opposing surfaces 34 that is located further away from where the blade body 21 is mounted.

While the above has described embodiments of the present invention in detail with reference to the drawings, each configuration of each embodiment and the combinations thereof are merely examples, and additions, omissions, substitutions, and other changes may be made without deviating from the spirit and scope of the present invention. The present invention is not to be considered as being limited by the foregoing description but is only limited by the scope of the appended claims.

For example, the embodiment described above had a configuration in which one tip shroud 22 is provided with one turbine blade 18. However the present invention is not limited thereto and one tip shroud 22 may be provided with a plurality of turbine blades 18.

INDUSTRIAL APPLICABILITY

According to this shroud, the protrusion acts as a dam and the fluid that convects in the radially outer region of the shroud stagnates. As a result, pressure rises at the radially outward outlet of the clearance causing the flow of the fluid flowing at these locations to be inhibited. In other words, the amount of fluid that leaks out from the clearance is reduced.

REFERENCE SIGNS LIST

1 Gas turbine
2 Compressor
3 Combustor
4 Turbine
6 Compressor rotor
7 Compressor casing
8 Compressor rotor shaft
9 Compressor blade array
10 Compressor blade
11 Compressor vane array
12 Compressor vane
14 Turbine rotor
15 Turbine casing
16 Turbine rotor shaft (rotor body)
17 Turbine blade array
18 Turbine blade (blade body, blade member)
19 Turbine vane array
20 Turbine vane
21 Blade body
22 Tip shroud (shroud, shroud body)
24 Outer surface
25 Upstream end surface
26 Downstream end surface
27 First circumferential end surface
28 Second circumferential end surface
31 First clearance
32 Second clearance
33 First opposing surface
34 Second opposing surface
35 Abutting end surface
36 Relief hole
38 Fin
40 Protrusion
41 Fluid contact surface
42 Inclined surface
44 Canopy portion
C Dimension of second clearance
D Space between radially outward surface of canopy portion and outer surface
H Radial height of protrusion
F Combustion gas flow direction
R Rotational direction

The invention claimed is:

1. A shroud comprising:

shroud bodies fixed to blade tips of blades mounted to a rotor body to extend in a radial direction, the shroud bodies being disposed adjacent to one another in a circumferential direction, wherein each of the shroud bodies includes:

a first circumferential end surface which is formed on one side in the circumferential direction, and which is formed on a leading side in a rotational direction of the blades;

a second circumferential end surface which is formed on the other side in the circumferential direction, and which is formed on a trailing side in the rotational direction of the blades; and an outer surface which is a surface facing radially outward, the first circumferential end surface and the second circumferential end surface include:

first opposing surfaces which are adjacent shroud bodies which face one another, and which are opposing surfaces intermediated by a first clearance on an upstream side of the shroud;

second opposing surfaces which are adjacent shroud bodies which face one another, and which are opposing surfaces intermediated by a second clearance on a downstream side of the shroud; and abutting end surfaces which are adjacent shroud bodies which abut one another, and disposed between the first opposing surfaces and the second opposing surfaces, in the first circumferential end surface and the second circumferential end surface, the first opposing surfaces, the abutting end surfaces and the second opposing surfaces are arranged in order from the upstream to the downstream of the shroud, and the outer surface is provided with a protrusion projecting radially outward and formed so that it extends along the second opposing surface of only the first circumferential end surface and in a direction intersecting the rotational direction of the rotor body, so as to reduce the amount of combustion gas leaking through the second clearance between the adjacent shroud bodies.

2. The shroud according to claim 1, wherein the second clearance has a distance between the second opposing surfaces that is greater at a side approximate to the abutting end surfaces; and the protrusion protrudes from the outer surface to a greater degree at the side approximate to the abutting end surfaces.

3. The shroud according to claim 1, wherein the protrusion includes a canopy portion that at least partially covers a radially outward side of the second clearance when viewed in the radial direction.

4. The shroud according to claim 3, wherein the canopy portion is disposed at the other side in the circumferential direction and is formed continuously with the second opposing surfaces.

5. A blade member comprising:

a blade body; and the shroud according to claim 1.

6. A rotary machine comprising:

a compressor that compresses outside air to generate compressed air, a combustor that combusts fuel in the presence of compressed air to generate combustion gas, and a turbine that is driven by high-temperature high-pressure combustion gas, wherein the turbine is provided with the blade member according to claim 5.

7. A shroud comprising:

shroud bodies fixed to blade tips of blades mounted to a rotor body to extend in a radial direction, the shroud bodies being disposed adjacent to one another in a circumferential direction, wherein each of the shroud bodies includes:

a first circumferential end surface which is formed on one side in the circumferential direction, and which is formed on a leading side in a rotational direction of the blades;

a second circumferential end surface which is formed on the other side in the circumferential direction, and which is formed on a trailing side in the rotational direction of the blades; and an outer surface which is a surface facing radially outward, the first circumferential end surface and the second circumferential end surface include:

first opposing surfaces which are adjacent shroud bodies which face one another, and which are opposing surfaces intermediated by a first clearance on an upstream side of the shroud;

second opposing surfaces which are adjacent shroud bodies which face one another, and which are opposing surfaces intermediated by a second clearance on a downstream side of the shroud; and abutting end surfaces which are adjacent shroud bodies which abut one another, and disposed between the first opposing surfaces and the second opposing surfaces, in the first circumferential end surface and the second circumferential end surface, the first opposing surfaces, the abutting end surfaces and the second opposing surfaces are arranged in order from the upstream to the downstream of the shroud, and the outer surface is provided with a protrusion projecting radially outward and formed so that it extends along the second opposing surface of only the second circumferential end surface and in a direction intersecting the rotational direction of the rotor body, and includes a canopy portion that at least partially covers a radially outward side of the second clearance when viewed in the radial direction, so as to reduce the amount of combustion gas leaking through the second clearance between the adjacent shroud bodies.

* * * * *